US006688340B1

(12) United States Patent
Awad

(10) Patent No.: US 6,688,340 B1
(45) Date of Patent: Feb. 10, 2004

(54) AUTOMOTIVE POWER STEERING FLUSH SYSTEM AND METHODS OF USE

(76) Inventor: Adam Awad, 1360 Logan Ave., #100, Costa Mesa, CA (US) 92626

( * ) Notice: Subject to any disclaimer, the term of this patent is extended or adjusted under 35 U.S.C. 154(b) by 0 days.

(21) Appl. No.: 10/287,574

(22) Filed: Nov. 4, 2002

(51) Int. Cl.[7] ..... B65B 1/04

(52) U.S. Cl. ..... 141/65; 141/7; 141/59; 141/98; 184/1.5

(58) Field of Search ..... 141/7, 37, 39, 141/59, 65, 95, 98; 184/1.5

(56) References Cited

U.S. PATENT DOCUMENTS

| | | | | |
|---|---|---|---|---|
| 4,408,960 | A | | 10/1983 | Allen |
| 5,318,080 | A | | 6/1994 | Viken |
| 5,415,247 | A | | 5/1995 | Knorr |
| 5,427,505 | A | | 6/1995 | Payne |
| 5,520,518 | A | | 5/1996 | Taguchi |
| 5,738,499 | A | | 4/1998 | Evans |
| 5,746,259 | A | * | 5/1998 | Noble, III ..... 141/92 |
| 5,806,629 | A | | 9/1998 | Dixon et al. |
| 5,853,068 | A | | 12/1998 | Dixon et al. |
| 6,035,902 | A | | 3/2000 | Dixon |
| 6,062,275 | A | | 5/2000 | Rome et al. |
| 6,247,509 | B1 | | 6/2001 | Rome et al. |
| 6,286,626 | B1 | | 9/2001 | Evans |
| 6,378,657 | B2 | | 4/2002 | Viken |
| 6,382,271 | B1 | | 5/2002 | Betancourt et al. |

* cited by examiner

*Primary Examiner*—Gregory L. Huson
*Assistant Examiner*—Peter deVore
(74) *Attorney, Agent, or Firm*—Gene Scott-Patent Law & Venture Group

(57) ABSTRACT

An apparatus for changing power steering fluid in an automotive power steering system, uses the components of an fluid receiving container; an fluid supply container; a utility fluid pump, a pressure actuated fluid valve; and a fluid conducting means. The components are arranged such that air is compressed in the fluid receiving container by entry of spent power steering fluid and builds to open the pressure actuated valve so as to drive replacement power steering fluid into the power steering system, replacing the spent fluid.

8 Claims, 1 Drawing Sheet

AUTOMOTIVE POWER STEERING FLUSH SYSTEM AND METHODS OF USE

BACKGROUND OF THE INVENTION

1. Field of the Invention

This invention relates generally to automotive flush systems and their methods of use and more particularly to a manual power steering fluid exchange system and method of use.

2. Description of Related Art

The following art defines the present state of this field:

Allen, U.S. Pat. No. 4,408,960 describes a pneumatic method and apparatus for causing the rapid recirculation of a liquid between a plurality of containers by adjusting the pressure of a gas exerted within each of said containers to superatmospheric, atmospheric and subatmospheric pressures, thereby avoiding the passing of the liquid through a mechanical flow-inducing pump. The containers are connected to each other by means of a liquid circulation system comprising a circulation conduit which includes a work station. A filled first container is subjected to superatmospheric pressure to force the liquid into the circulation system while a second empty container is subjected to subatmospheric pressure to suck the liquid from the circulation system. After each container is empty and before it is subjected to subatmospheric pressure, for refilling purposes, it is exposed to atmospheric pressure to release the elevated pressure therefrom. The circulation system preferably incorporates a bypass conduit including a liquid replenishment tank and/or means for adjusting the temperature of the liquid.

Viken, U.S. Pat. No. 5,318,080 describes fluid changing in an automatic transmission by opening the cooler line and draining used fluid, at the flow of normal circulation, out of the cooler line from the transmission into a drain receptacle for receiving used fluid and simultaneously supplying fresh fluid, from a pressurized supply receptacle, into the cooler return line to the transmission at a similar controlled rate that is equal or greater than the rate of flow of the used fluid into the drain receptacle.

Knorr, U.S. Pat. No. 5,415,247 describes an automotive fluid exchange system wherein new fluid (such as power steering fluid) is simultaneously exchanged with the used fluid. First and second fluid conduits having first and second pumps disposed therein, respectively, provide the passageway between an engine compartment and a container for the new and used fluid, respectively. The two pumps are selectively actuable by a respective, conventional toggle switch. Conventional jumper cables provide the power supply means to drive the pumps.

Payne, U.S. Pat. No. 5,427,505 describes an apparatus for extracting and injecting liquid coolant from and into a reservoir for an engine cooling system. The apparatus includes a storage tank for the liquid coolant, and an air pressure system for selectively applying fluid pressure to the tank either above or below atmospheric pressure. A hose connects the tank to the engine cooling system reservoir through a double shut-off-type coupling. One part of the coupling is connected to the reservoir, and the other, to the end of the transfer hose each having its own independent shut-off valve. When the coupling is connected, the valves in both components are opened and conversely when the coupling is disconnected, the valves automatically close.

Taguchi, U.S. Pat. No. 5,520,518 describes a method of transferring fluent material transferring the material from a first pressure tank to a fluent material transfer destination by supplying compressed gas to the first tank through a compressor. The compressed gas is retained in the first tank for reuse. Additional fluent material is drawn into a second pressure tank and is transferred therefrom to the fluent material transfer destination by supplying the compressed gas from the first pressure tank to the second pressure tank through the compressor. The compressed gas is further retained in the second pressure tank transferring fluent material from the first pressure tank. As the compressed gas is emptied from each tank to the other tank, additional fluent material is drawn into that tank. The cycle can be repeated on a continuous basis to transfer large quantities of fluent material.

Evans, U.S. Pat. No. 5,738,499 describes a fluid delivery/extracting device for extracting fluid from and delivering fluid to a reservoir of a vehicle. The device includes a cylindrical body formed from a tube, a bottom member and a top member. The top member comprises an annular member and a closure which closes the annular member. A pair of fittings extending through the closure, one of which has a portion extending below the closures top surface. A dip tube is applied to the this fitting and extends nearly to the bottom of the container. A first hose extends from the first fitting outer portion to a reservoir to be filled or emptied and is sufficiently long to extend to the bottom of the reservoir. A second hose extends from the second fitting and is connectable to any vacuum port of a vehicle if the device is to be used to empty the reservoir, or to a supply of pressurized air, if the device is to be used to fill the reservoir. The device makes it fairly simple to extract fluid from and deliver fluid to even hard to reach reservoirs, and reservoirs which are filled with highly viscous fluids.

Dixon et al., U.S. Pat. No. 5,806,629 describes a fail-safe transmission service machine allowing old ATF to be pumped out of a transmission while the vehicle engine runs, and responsively pumps a matching volume of new ATF into the transmission so that dry running of the transmission can hot occur. If the supply of new ATF runs out or if power to the service machine is interrupted, the machine reverts to closed loop fluid circulation for the transmission. A hydraulic rectifier provides for universal connection of hoses between the transmission cooler fluid circulation loop of the vehicle and the service machine. An alternative embodiment of the machine allows for similarly fail-safe exchange of power steering fluid from a vehicle, and replacement of the old fluid with new power steering fluid.

Dixon et al., U.S. Pat. No. 5,853,068 describes an automotive fluid service machine for changing fluids such as automatic transmission fluid, power steering fluid, and engine coolant, including a cabinet with a unitary integral fluid reservoir defined by a lower portion of the machine cabinet. This lower cabinet portion which integrally defines the fluid reservoir also provides a machinery deck to which the components of the machines are mounted. A cap portion of the cabinet provides a cavity for protecting the components mounted to the machinery deck and also provides a control panel for the machine in addition to providing fluid fill and drainage basins improving the convenience and safety of use for the machine. The safety of a service area is improved by the machine because a very low center of gravity for the machine reduces the risk of tipping of a machine and of spilling fluids. Thus, environmental concerns from such spills as well as the risk of personnel slips and falls on spilled fluids are reduced.

Dixon, U.S. Pat. No. 6,035,902 describes a fail-safe service machine for the power steering system of automotive vehicles including a pair of pumps each driven by electrical power from a vehicle under service, and a suction/delivery probe extending into the power steering system reservoir of the vehicle, both to remove old power steering fluid, and to simultaneously deliver new power steering fluid.

Rome et al., U.S. Pat. No. 6,062,275 describes an apparatus and method of replacing old fluid in a transmission system by feeding clean fluid into the system from a clean fluid tank using a pump and draining the old fluid into a waste tank and using a processor to monitor the clean fluid pressure in the clean tank and the old fluid pressure in the waste tank and adjusting the pump's speed using the processor such that the old fluid is drained at substantially the same rate as the clean fluid is fed.

Rome et al., U.S. Pat. No. 6,247,509 describes and apparatus and method of replacing old fluid in a transmission system by feeding clean fluid into the system from a clean fluid tank using a pump and draining the old fluid into a waste tank and using a processor to monitor the clean fluid pressure in the clean tank and the old fluid pressure in the waste tank and adjusting the pump's speed using the processor such that the old fluid is drained at substantially the same rate as the clean fluid is fed.

Evans, U.S. Pat. No. 6,286,626 describes an automated system for changing the motor oil in an engine. The system includes a drain plug having a plurality of channels coupled with tubing that extends to a reversible pump. Tubing extends from the pump to both a used oil container and a new oil container. Check valves positioned at the entrance of each container restrict flow so the oil can flow only to the used oil container and only flows from the new oil container. Preferably, both containers are located in the trunk of the vehicle for easy access. In use, the pump is engaged to draw the used motor oil from the engine into the used oil container. Next, the pump is reversed to draw fresh oil from the new oil container into the engine.

Viken, U.S. Pat. No. 6,378,657 describes fluid changing in an automatic transmission by opening the cooler line and draining used fluid, at the flow of normal circulation, out of the cooler line from the transmission into a drain receptacle for receiving used fluid and simultaneously supplying fresh fluid, from a pressurized supply receptacle into the cooler return line to the transmission at a similar controlled rate that is equal or greater than the rate of flow of the used fluid into the drain receptacle.

Betancourt et al., U.S. Pat. No. 6,382,271 describes an apparatus and method of replacing old fluid in a transmission system by feeding clean fluid into the system from a clean fluid tank using a pump and draining the old fluid into a waste tank and using a processor to monitor the clean fluid pressure in the clean tank and the old fluid pressure in the waste tank and adjusting the pump's speed using the processor such that the old fluid is drained at substantially the same rate as the clean fluid is fed.

The prior art teaches the use of carts for providing automotive maintenance and especially in the field of power steering fluid change out, but does not teach a system with the combination of features and automated controllability of the present invention. The present invention fulfills these needs and provides further related advantages as described in the following summary.

SUMMARY OF THE INVENTION

The present invention teaches certain benefits in construction and use which give rise to the objectives described below.

An apparatus for changing power steering fluid in an automotive power steering system, uses the components of an fluid receiving container; an fluid supply container; a utility fluid pump, a pressure actuated fluid valve; and a fluid conducting means. The components are arranged such that air is compressed in the fluid receiving container by entry of spent power steering fluid and builds to open the pressure actuated valve when about 80–90 percent of the spent fluid has been drawn out of the power steering system, so as to drive replacement power steering fluid into the power steering system, replacing the spent fluid.

A primary objective of the present invention is to provide an apparatus and method of use of such apparatus that provides advantages not taught by the prior art.

Another objective is to provide such an invention capable of moving fluids between containers and an automotive power steering system in such a manner that when 80–90 percent of the spent fluid is removed, only then, will replacement fluid be driven into the power steering system.

A further objective is to provide such an invention capable of quick and easy change of power steering fluid without complex supervision steps.

A still further objective is to provide such an invention capable of manually controlling the exact amount of fluid necessary to replace the fluid in an automotive power steering system in such a manner that the power steering system cannot be operated without sufficient fluid.

Other features and advantages of the present invention will become apparent from the following more detailed description, taken in conjunction with the accompanying drawings, which illustrate, by way of example, the principles of the invention.

BRIEF DESCRIPTION OF THE DRAWINGS

The accompanying drawing illustrates the present invention. In such drawing.

DETAILED DESCRIPTION OF THE INVENTION

Figure 1:
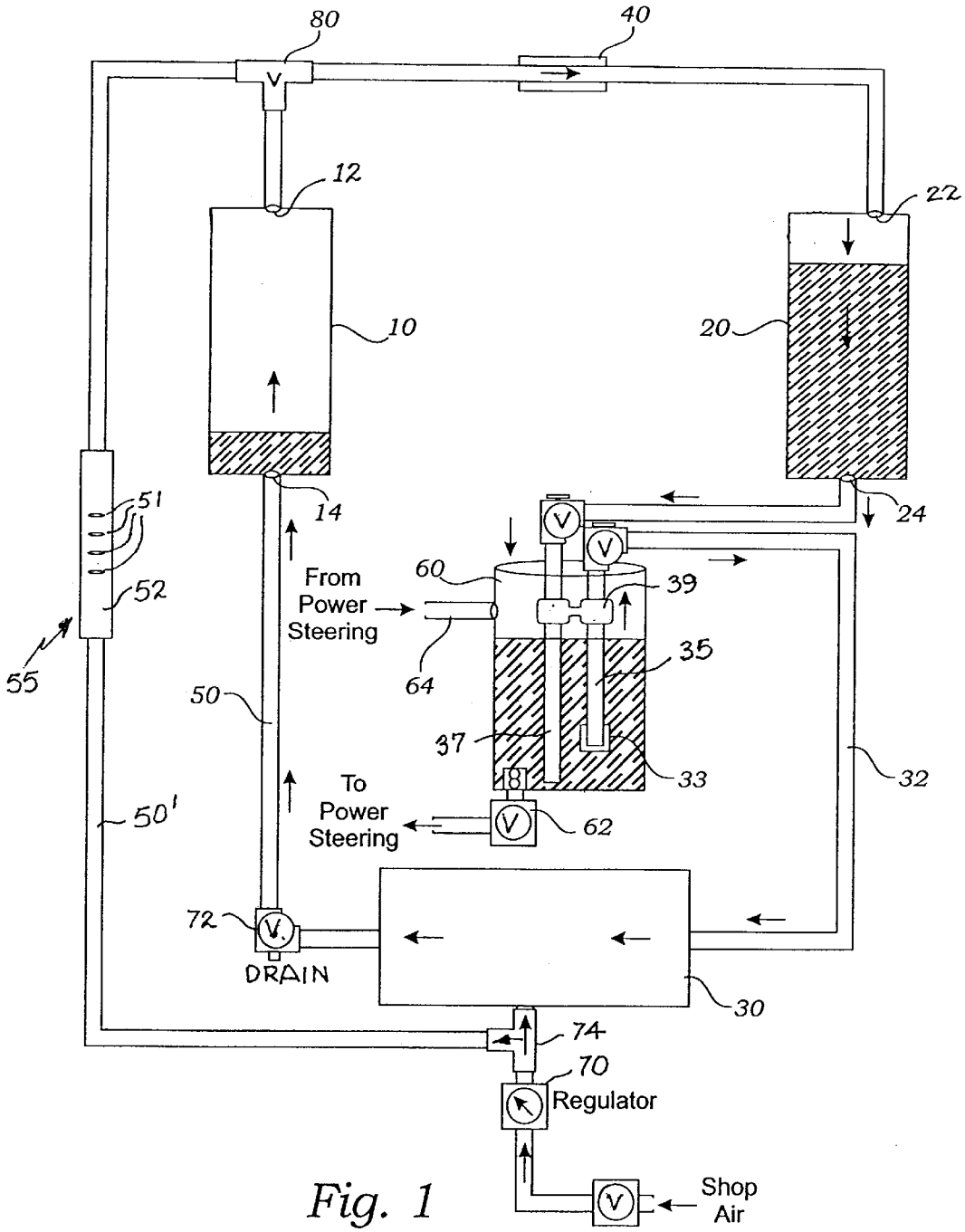
FIG. 1 is a schematic diagram of the invention as used with an automotive power steering system.

The above described drawing figures illustrate the invention in at least one of its preferred embodiments, which is further defined in detail in the following description.

The present invention is an apparatus for changing power steering fluid in an automotive power steering system, the later identified by numeral 33 in FIG. 1. The apparatus primarily comprises the operating components of: a fluid receiving container 10, a fluid supply container 20, a utility fluid pump 30 of any common type capable of pumping both air and a viscous fluid such as power steering fluid, a pressure actuated fluid valve 40, and a fluid conducting means 50 such as plastic tubing of the type that is reinforced so as to not bulge under pressure nor collapse under vacuum. The containers 10 and 20 are constructed so that fluids, including air, can only flow into or out of the containers via ports, as shown in FIG. 1, i.e., the containers 10, 20 and the fluid conducting means 50 and their interconnections are not subject to leaks up to a selected pressure. The components are arranged such that fluids, both air and PS fluid are forced to flow in the apparatus due to the fluid pump 30. Fluid flows from the power steering system 60 into the utility fluid pump 30 by suction in tube 35 of line 32, under suction established by the utility pump 30, and is then forced by its pumping action into port 14 of the fluid receiving container 10 for later disposal. Please note that suction line 32 is one section or part of fluid conducting means 50 which comprises all of the interconnecting tubing. The novelty of this arrangement is that when utility pump 30 sucks expended PS fluid from the power steering pump 60 it enters fluid. receiving container 10 causing the air pressure in this container 10 to rise. When 80–90 percent of the spent PS fluid has entered container 10 the pressure reaches the level for opening pressure actuated valve 40. At this point, this pressure starts the flow of replacement fluid from container 20 into the PS system. The sizes of the containers 10, 20 and of the PS fluid conducting means 50 are such that the amount of spent PS fluid sucked out of power steering system 33 results in about 80–90% of the spent PS fluid being withdrawn before new PS fluid enters. This is a critical and novel aspect of the invention and clearly results in a benefit of significant value, i.e., only 10–20% of the old PS fluid is left to be mixed with the new PS fluid; the system 33 cannot run dry, which would result in damage to the system, and the removal of the spent PS fluid and insertion of the new PS fluid is accomplished without supervision, basically automatically. PS fluid is shown with cross-hatching in FIG. 1. As stated, the process is conducted while the engine of the vehicle is running so that the PS fluid is drawn off and replaced in a continuous process, e.g., while circulating through the PS system 60 via lines 62 and 64 respectively. This has the advantage of assuring that most of the PS fluid is extracted from the PS system prior to inserting the new PS fluid. The utility pump 30 may be of any type capable of driving PS fluid, and as shown in FIG. 1 it is preferably driven by a source of compressed air (shop air) through a regulator 70. Valve 80, enables the use of shop air to drain containers 10 and 20 when necessary. Preferably the suction line tube 35 terminates with a magnetic suction nozzle 33 for capturing metal finds in the PS fluid. Such metal finds, i.e., metallic dust and other particles often tend to clog the power steering lines and valves so that capture of this material is of importance. The replacement PS fluid enters PS fluid system 33 through tube 37. Tubes 35 and 37 are rigid and joined by bracket 39 so that tubes 35 and 37 are manually moved together into the pump reservoir of PS system 33, and likewise withdrawn together. It is noted that in FIG. 1, tube 37 extends to a greater depth than does tube 35. This differential is adjustable depending on how much minimum PS fluid head is to be allowed, which means that all of the PS fluid in reservoir 33 cannot be withdrawn since tube 37 limits the physical movement of tube 35 so that it cannot be brought to the bottom of the PS system reservoir. This highly novel element of the present invention assures that the PS system cannot be run dry. Bracket 39 enables the adjustment of the tubes 35 and 37 relative to each other so that the minimum amount of PS fluid in the PS system reservoir may be selected. Such mechanical adjustment will be known and achieved by those of skill in the art. Container 10 is drained through bottom port 14 and valve 72 when necessary. Shop air is delivered to the containers through side tube 50' using valve 74, valve 80 and ports 12 and 22. Valve 55 is comprised of tube 50' which has holes 51 in it and has an outer tube 52 mounted tightly over it, including is covering the holes 51. This valve 55 acts as a pressure relief or limiter because as pressure is applied by the shop air supply to tube 50' escaping air expands the outer tube 52 through holes 51, thereby allowing some air to escape and this escaped air flow is greater, the greater the applied pressure.

In the preferred embodiment, containers 10 and 20 are about two feet in length and four inches in diameter, and the fluid conduction means (tubes) are ⅜ inch inside diameter. The pressure actuated valve 40 is set to open at a specified pressure in the range of 3–6 psi, and this combination has been shown to automatically extract about 80–90% of the old PS fluid in a PS system holding about 2 quarts of PS fluid, prior to starting delivery of the replacement PS fluid. Other combinations of container and tube sizes and length can be used in the present invention just as well, and the opening pressure at pressure actuated valve 40 can be set to start delivery of the replacement PS fluid at any desired stage in the process.

While the invention has been described with reference to at least one preferred embodiment, it is to be clearly understood by those skilled in the art that the invention is not limited thereto. Rather, the scope of the invention is to be interpreted only in conjunction with the appended claims.

What is claimed is:

1. An apparatus for change out of a power steering fluid, the apparatus comprising the components of: a fluid receiving container having initially no PS fluid therein; a fluid supply container holding a replacement PS fluid; a utility fluid pump; a pressure actuated valve; and a fluid conducting means; the components arranged such that air and PS fluid are forced to flow:

a) from a power steering system, initially containing a spent PS fluid, into the utility fluid pump;

b) from the utility fluid pump into the fluid receiving container;

c) from the fluid receiving container, through the pressure actuated valve into the fluid supply container; and d) from the fluid supply container into the power steering system;

the receiving container, the pressure actuated valve and the fluid conducting means sized and configured for opening the pressure actuated valve when between 80 and 90 percent of the spent PS fluid has been transferred to the receiving container thereby compressing air in the receiving container and the fluid conducting means between the receiving container and the pressure actuated valve, such that, upon opening of the pressure actuated valve, the replacement PS fluid is forced into the power steering system.

2. The apparatus of claim 1 further comprising a magnetic suction nozzle terminating the fluid conducting means within the power steering system.

3. The apparatus of claim 1 wherein the fluid conducting means comprises a pair of tubes joined and arranged such that one of the tubes extends beyond the other one of the tubes, the tubes engaged for delivery of the replacement PS fluid through the one of the tubes and the spent fluid is suctioned into the other one of the tubes, whereby it is not possible to withdraw all of the spent PS fluid from the PS system.

4. The apparatus of claim 3 further comprising a magnetic suction nozzle terminating the fluid conducting means within the power steering system.

5. The apparatus of claim 3 wherein the fluid conducting means comprises a pair of tubes joined and arranged such that one of the tubes extends beyond the other one of the tubes, the tubes engaged for delivery of the replacement PS fluid through the one of the tubes and the spent fluid is suctioned into the other one of the tubes, whereby it is not possible to withdraw all of the spent PS fluid from the PS system.

6. An apparatus for change-out of a power steering fluid, the apparatus comprising the components of: a power steering system initially containing a spent PS fluid; a fluid receiving container having initially no PS fluid therein; a fluid supply container holding a replacement PS fluid; a utility fluid pump; a pressure actuated valve; and a fluid conducting means; the components arranged such that air and PS fluid is forced to flow:

e) from the power steering system into the utility fluid pump;

f) from the utility fluid pump into the fluid receiving container;

g) from the fluid receiving container, through the pressure actuated valve into the fluid supply container; and h) from the fluid supply container into the power steering system;

the receiving container, the pressure actuated valve and the fluid conducting means sized and configured for opening the pressure actuated valve when between 80 and 90 percent of the spent PS fluid has been transferred to the receiving container thereby compressing air in the receiving container and the fluid conducting means between the receiving container and the pressure actuated valve, such that, upon opening of the pressure actuated valve, the replacement PS fluid is forced into the power steering system.

7. A method for change out of a power steering fluid, the method comprising the steps of:

interconnecting a power steering system initially containing a spent PS fluid; a fluid receiving container having initially no PS fluid therein; a fluid supply container holding a replacement PS fluid; a utility fluid pump; and a pressure actuated valve; with a fluid conducting means; forcing air and PS fluid to flow from the power steering system into the utility fluid pump; from the utility fluid pump into the fluid receiving container; from the fluid receiving container, through the pressure actuated valve when between 80 and 90 percent of the spent PS fluid has been transferred to the receiving container, into the fluid supply container; and from the fluid supply container into the power steering system to replace the spent PS fluid.

8. The method of claim 7 further comprising the steps of applying a pair of tubes joined and arranged such that one of the tubes extends beyond the other one of the tubes; engaging one of the tubes for delivery of the replacement PS fluid; engaging the other one of the tubes for suctioning the spent PS fluid; whereby with the tubes inserted into the PS system it is not possible to withdraw all of the spent PS fluid from the PS system.

* * * * *